US005577291A

United States Patent [19]

Myers et al.

[11] Patent Number: 5,577,291

[45] Date of Patent: Nov. 26, 1996

[54] DECORATIVE PAINT ROLLER DEVICE

[76] Inventors: Micheal J. Myers; Caroline W. Myers, both of 2891 Pua Nani St., Linue, Hi. 96766

[21] Appl. No.: 581,773

[22] Filed: Jan. 2, 1996

[51] Int. Cl.[6] ..... B05C 17/02

[52] U.S. Cl. ..... 15/230.11; 15/210.5; 15/230.14; 15/230.19

[58] Field of Search ..... 15/230.11, 235, 15/230.16, 210.5, 230.14, 230.19

[56] References Cited

U.S. PATENT DOCUMENTS

| | | | |
|---|---|---|---|
| 2,645,845 | 7/1953 | Vengris | 15/230.11 |
| 2,647,276 | 8/1953 | Thomas et al. | 15/230.11 |
| 3,448,479 | 6/1969 | Cadematori | 15/230.11 |
| 3,649,986 | 3/1972 | Dahlund | 15/230.11 |
| 3,669,069 | 6/1972 | Bourboulis | 118/102 |
| 4,191,792 | 3/1980 | Janssen | 427/260 |
| 4,198,723 | 4/1980 | Hiller et al. | 15/230.11 |
| 4,201,801 | 5/1980 | Hori | 427/247 |
| 4,293,599 | 10/1981 | Hori et al. | 427/247 |
| 4,320,553 | 3/1982 | Charles | 15/230.11 |
| 4,338,698 | 7/1982 | Beer et al. | 15/230.16 |
| 4,653,135 | 3/1987 | Clark | 15/230.16 |
| 4,930,179 | 6/1990 | Wright et al. | 15/230.11 |
| 5,000,671 | 3/1991 | Nolte | 425/231 |
| 5,117,529 | 6/1992 | Ohta | 15/230.11 |
| 5,186,674 | 2/1993 | Beckhusen et al. | 15/230.11 |
| 5,206,979 | 5/1993 | Campbell | 492/13 |
| 5,401,231 | 3/1995 | Herbert | 492/37 |
| 5,471,703 | 12/1995 | Niven | 15/230.11 |

FOREIGN PATENT DOCUMENTS

| | | | |
|---|---|---|---|
| 0302662B1 | 9/1992 | European Pat. Off. . | |
| 1169134 | 9/1958 | France | 15/230.11 |
| 0749585 | 5/1956 | United Kingdom | 15/230.14 |
| 9314879 | 8/1993 | WIPO | 15/230.11 |

*Primary Examiner*—David Scherbel
*Assistant Examiner*—James F. Hook
*Attorney, Agent, or Firm*—Goldstein & Associates

[57] ABSTRACT

A paint rolling device comprising a roller rotatably mountable on an axle of a standard roller frame. One or more cartridge retaining apparatus are positioned incrementally around the roller, the retaining apparatus preferably consisting of elongated channels positioned longitudinally around the roller for removably engaging cartridges. Each cartridge has an elongated rod sized for slidable engagement with one of the channels and a flap secured, at a proximal end, to the rod. A distal end of the flap is formed with a pattern or design to be painted on the surface. Thus, to change the pattern to be painted on the surface, the cartridges secured in the channels are simply replaced with cartridges having the desired pattern on the distal end of the flap.

6 Claims, 2 Drawing Sheets

DECORATIVE PAINT ROLLER DEVICE

BACKGROUND OF THE INVENTION

1. Field of the Invention

This invention relates generally to paint roller devices, and more particularly to an improved paint roller designed to removably receive cartridges that produce a decorative paint effect on a flat surface.

2. Background and related art

Paint rollers are well known in the art as a fast and convenient means by which to coat a flat surface with a layer of paint. Unfortunately, such rollers are only capable of spreading a uniform coat of a given paint color across the surface, and cannot be effectively used to create designs or patterns on the surface. In the 1930's painting techniques such as rag rolling and sponging became popular as a means to attain a decorative, patterned paint coating on a wall, ceiling or the like. Unfortunately, such techniques generally required a great deal of time and skill to successfully complete, making them unfeasible options for the general public. As a result, those wishing to obtain decorative patterns typically have had to resort to covering their walls with wallpaper. However, wallpaper is also very expensive, and its application requires skills that many people do not possess. Wallpaper is also undesirable because its removal is an arduous process that requires a good deal of time.

More recently, rolling devices designed to apply paint in a decorative manner have become available. One such device, disclosed in U.S. Pat. No. 5,117,529, to Ohta, consists of a roller having an elastic sheet secured to its surface. The elastic sheet has several different shapes and patterns, thus creating a painted pattern when the roller is rotated across the surface to be coated. Unfortunately, this device is capable of creating only a limited number of different patterns. In addition, while it is substantially easier than prior art rolling and sponging methods, it still requires a degree of artistic knowledge and skill, as patterns are created only when the roller is rotated in such a way that the paint is thrown onto a surface to be painted by means of centrifugal force. This is a substantial disadvantage when the device is used to create a repetitive pattern, as the user must appropriately realign the roller and rotate it with the same amount of centrifugal force across the entire surface in order to create a continuous pattern.

Other such devices are disclosed in U.S. Pat. No. 4,930,179 to Wright et al. and European Patent No. 302,662,B1 also issued to Wright et al. These devices have flexible flaps extending outwardly from a roller so that when the roller is rolled across a freshly painted surface, the flaps strike the paint and create a broken pattern. While these devices are somewhat simpler to use than other prior art devices, they are significantly limited in that the flaps are permanently secured to the roller, thus allowing only a single pattern to be created with the device. Although the elastic sheet of Ohta's device includes several different shapes, it too is limited to producing only a set number of patterns. This is a significant disadvantage of these prior art devices, as it forces consumers to purchase a separate roller device for each new pattern desired.

Thus there is a clear need for an improved paint roller device that would allow the user to create an infinite number of designs and patterns with a single roller device. Such a device would be easy to use, require no special skills or knowledge to use, and would be relatively inexpensive. The present invention fulfills these needs and provides further related advantages as described in the following summary.

SUMMARY OF THE INVENTION

It is a primary object of the present invention to provide a paint rolling device that can be used to create a decorative paint design on a flat surface. It is another object of the present invention to provide a device that is as easy to use and operate as a standard paint roller so that decorative patterns can be easily created by people having no special painting skills.

It is yet another object of the present invention to provide a plurality of interchangeable cartridges that are removably attached to the roller, thus allowing an infinite number of patterns and designs to be created with a single rolling device. This is a significant advantage of the present invention, as the decorating element of all other prior art devices is fixed integrally to the roller, thus limiting the number of designs that can be achieved with a single rolling device. With the present invention, however, a unique design is created each and every time a new cartridge is secured to the roller.

It is another object of that the present invention comprises relatively few parts, thus making the device relatively inexpensive to manufacture. Still further, it is an object of the device to be easily rotatably mounted onto an axle of a standard, commercially available roller frame. This is a significant advantage of the present invention, as it allows the user to select the frame type that is personally most comfortable to use. It is also a significant advantage in that it reduces costs for the consumer who already owns many standard paint rollers.

The invention is a paint roller device comprising a roller that is rotatably mountable on the axle of a standard roller frame. Several channels are positioned along the length of the roller for removably accepting cartridges. Each cartridge has an elongated rod sized for slidable engagement with each channel and a flap secured to and extending from the rod. When the cartridge is positioned within the channel, the flap extends radially outwardly from the roller.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWING

In the drawings, like elements are depicted by like reference numerals. The drawings are briefly described as follows.

DETAILED DESCRIPTION OF THE PREFERRED EMBODIMENT

FIGS. 1–3B illustrate a decorating roller device designed to enable a variety of different designs to be easily painted on a flat surface. The roller device is designed to be used in conjunction with any standard paint roller frame. Such frames typically include a handle that is positioned approximately perpendicularly to an axle. The present inventive roller device has an elongate roller 20 with a hollow core 25 running longitudinally through the roller 20. The diameter of the hollow core 25 is larger than the axle of the roller frame, the roller 20 thus being rotatably mountable on the axle.

Figure 2A:
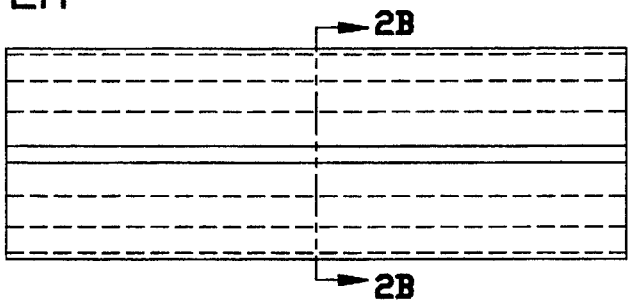
FIG. 2A is a side elevation view of the roller of the invention.
Figure 2B:
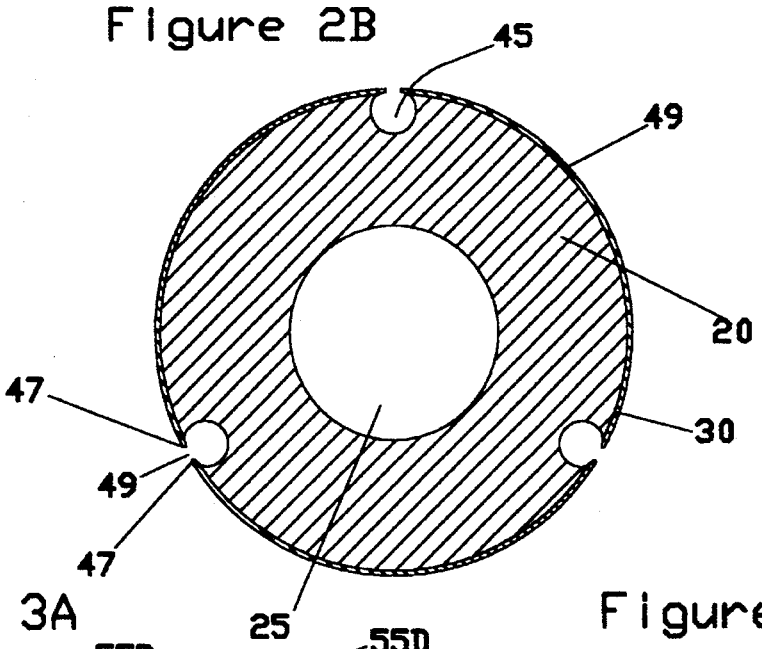
FIG. 2B is a cross sectional view of the invention, taken in the direction of cutting plane line 2B—2B in FIG. 2A, illustrating the incremental placement of the channels around the roller.

A covering 30 is preferably positioned over an outer surface of the roller 20 so as to completely cover said outer surface. The covering 30 preferably comprises a lightweight plastic or cardboard tube fixed securely to the roller's outer surface, and a sheet of porous fabric, such as cheesecloth, synthetic fibers or the like, fixed securely to the tube. Alternately, as seen in FIG. 2B, the covering 30 may consist solely of a sheet of fabric.

At least one cartridge retaining means 40 is formed integrally with the roller 20, and preferably three or more retaining means 40 are provided. In the preferred embodiment, illustrated in FIGS. 1 and 2B, the cartridge retaining means 40 consist of elongated channels 45 that span the entire length of the roller 20. These channels 45 are preferably positioned incrementally around the outer surface of the roller 20.

Figure 3A:
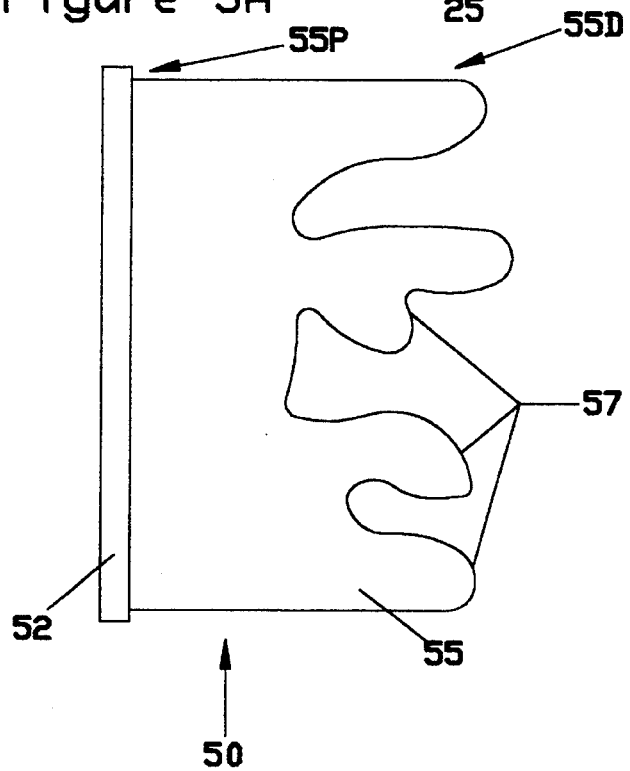
FIG. 3A is a elevation view of just the cartridge, particularly illustrating the pattern cut into a distal end of a flap of the cartridge.
Figure 3B:
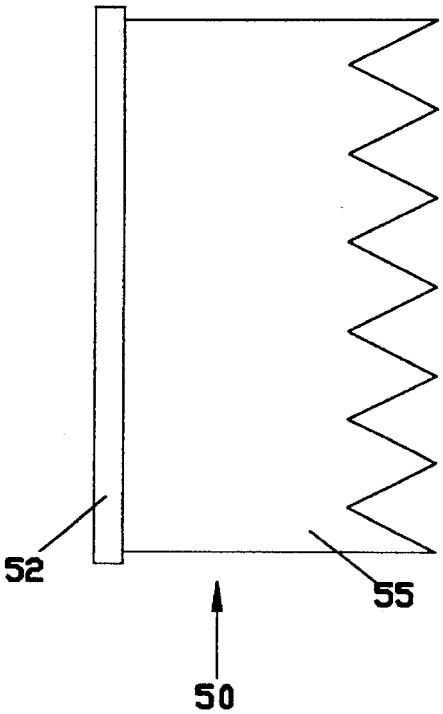
FIG. 3B is a side elevation view of another embodiment of the cartridge, illustrating another pattern cut into the distal end of the flap.

A plurality of cartridges 50 are included with the present inventive paint roller device. Each cartridge 50 consists generally of an elongated rod 52 and a flap 55. A proximal end 55P of the flap 55 is secured to the rod 52, and a distal end 55D of the flap 55 extends away from the rod 52. The distal end 55D of the flap preferably has a design or pattern 57 formed integrally in it, as illustrated in FIGS. 3A and 3B. The flap 55 may be constructed of a material that can be easily cut with a knife, fabric scissors or the like so that the user can cut custom designs and patterns into the distal ends 55D of the flaps 55. The elongated rods 52 have a shape and size complementary to that of the channels 45 in the roller 20 so that the cartridges 50 are easily slidably engaged with the roller 20 simply by inserting the rods 52 of each cartridge 50 into one of the channels 45. Likewise, the cartridges 50 are easily removed from the roller 20 by simply sliding the rods 52 out of engagement with the channels 45. This is a critical aspect of the present invention, as it allows an infinite number of patterns and designs to be painted on a surface simply by interchanging the cartridges 50 as desired.

Figure 1:
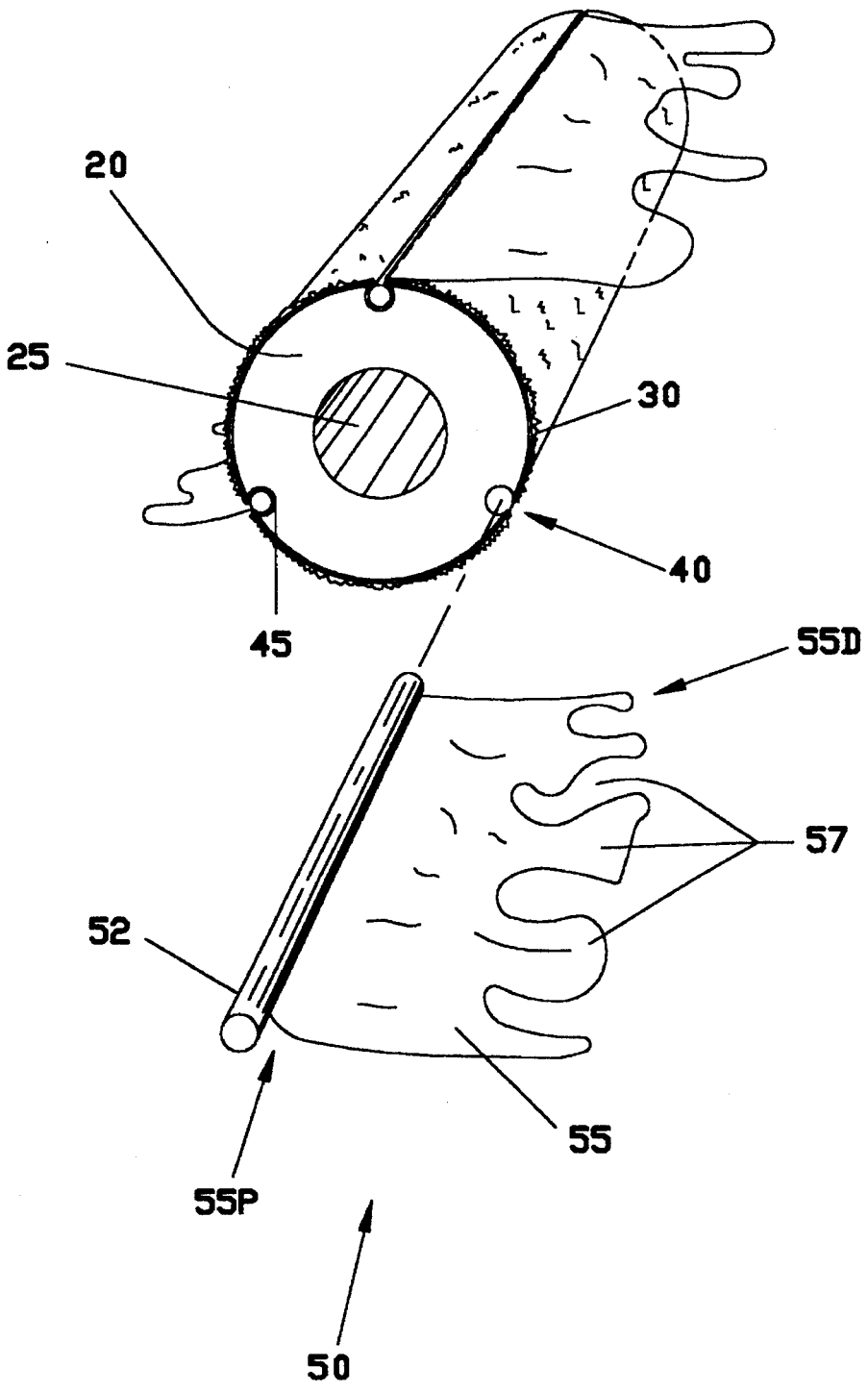
FIG. 1 is a perspective view of the preferred embodiment of the present invention, particularly showing the positioning of cartridges within corresponding channels in a roller.

When the rods 52 is appropriately positioned within the channels 45, as seen in FIG. 1, the flaps 55 extend radially outwardly from the roller 20. Preferably, each cartridge retaining means 40 includes a pair of lips 47 positioned on opposing sides of the channel 45 and extending inwardly over the channel 45. The lips 47 define a slot 49 in the outer surface which extends the length of the roller. When a cartridge 50 is fully inserted into one of the channels 45, the lips 47 prevent the rod 52 from inadvertently moving upwardly out of the channel 45. The lips 47 also fit closely around the outwardly extending flap 55, thus preventing the cartridge 50 from rotating excessively within the channel 45 during use, and thus maintain the flaps in their radially outward extending position.

In conclusion, herein is presented a roller device for painting decorative patterns and designs on a flat surface. While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A paint roller device to be used in conjunction with a paint roller frame having a handle and an axle, the handle positioned substantially perpendicular to the axle, for enabling decorative patterns to be painted on a flat surface, the roller device comprising:

a roller having a hollow inner core, a length, and an outer surface, the roller rotatably mounted to the axle of the paint roller frame;

at least one cartridge retaining means comprising an elongated channel extending along the length of the roller and formed integrally within the roller near the outer surface; and a plurality of cartridges, the cartridges being removably, slidably engaged with the cartridge retaining means of the roller wherein each of the cartridges comprises an elongated rod and a flap, the flap having a proximal end secured to the rod and a distal end extending outwardly from the rod such that with the rod slidably engaged within the elongated channel in the roller, the flap extends substantially radially outwardly from the roller.

2. The paint roller device as recited in claim 1, wherein the at least one cartridge retaining means further includes a pair of lips positioned on opposing sides of the channel, the lips extending over the channel and defining a slot in the outer surface that extends the length of the roller, the lips fitting closely around the outwardly extending flap so as to prevent the cartridge from rotating substantially within the channel and thus maintain the flaps in the outwardly extending position.

3. The paint roller device as recited in claim 2, wherein each cartridge further includes a pattern or design formed integrally in the distal end of the flap.

4. The paint roller device as recited in claim 3, further including a covering fixedly secured to the outer surface of the roller.

5. The paint roller device as recited in claim 4, having three or more elongated channels positioned incrementally around the outer surface.

6. The paint roller device as recited in claim 1, having three or more elongated channels positioned incrementally around the outer surface.

* * * * *